United States Patent [19]

Kelly et al.

[11] 4,212,402

[45] Jul. 15, 1980

[54] GARMENT DISPLAY RACK

[75] Inventors: Edmund R. Kelly, Downey; Thomas V. Orona, Sr., El Monte, both of Calif.

[73] Assignee: Rax-Unlimited, South Gate, Calif.

[21] Appl. No.: 922,989

[22] Filed: Jul. 10, 1978

[51] Int. Cl.[2] ..... A47F 5/08

[52] U.S. Cl. ..... 211/105.3; 211/123; 211/193

[58] Field of Search ..... 211/105.3, 123, 105.1, 211/182, 183, 193, 195, 87, 96, 206; 248/287, 285, 286; 403/59.63

[56] References Cited

U.S. PATENT DOCUMENTS

| | | | |
|---|---|---|---|
| 610,101 | 8/1898 | Sullivan | 403/59 |
| 1,064,145 | 6/1913 | Jacobs | 403/59 |
| 2,461,457 | 2/1949 | Weber | 211/105.3 |
| 2,639,930 | 5/1953 | Thornton | 211/105.3 X |
| 3,166,286 | 1/1965 | Pfaff | 211/105.3 X |
| 3,322,288 | 5/1967 | Mayer | 211/193 |
| 3,341,028 | 9/1967 | Nichols | 211/182 X |
| 3,854,686 | 12/1974 | Konstant | 211/193 X |

FOREIGN PATENT DOCUMENTS

| | | | |
|---|---|---|---|
| 503797 | 6/1951 | Belgium | 211/182 |

*Primary Examiner*—Roy D. Frazier
*Assistant Examiner*—Robert W. Gibson, Jr.

[57] ABSTRACT

The specifications describe an apparatus for displaying garments and other articles of clothing which are customarily suspended on hangers. Lineal as well as angular variations of the suspension bar are effected through the utilizations of a pivotally sleeved arrangement. Asthetic groupings and orientations may be used to provide an attractive background to enhance saleability.

5 Claims, 3 Drawing Figures

GARMENT DISPLAY RACK

DESCRIPTION OF THE PRIOR ART

In displaying garments and other articles of clothing, it is customary to utilize a longitudinal bar from which the displayed apparel is suspended via hangers. In the usual situation, the garments are stacked in contiguous contact (commonly known as shoulder hung), at right angles to the axis of viewing, so that any item of interest must be removed and hung apart from the rack. There is, in general, no way to easily arrange the display to emphasize one or more different items (face-out orientation), nor is there a convenient means for easily viewing a particular item without removing it from the rack. The racks themselves are generally not beneficial from the standpoint of utilizing the merchandise as a means of enhancing the appearance of the display environment, nor is there a subtle means whereby the features of a particular item may be emphasized. What is actually desired is a display rack for suspending clothing or other articles which will permit orientational and displacement variations of the suspension bars.

Accordingly, a primary object of the present invention is to provide a clothing display having a moveable suspension bar.

A further object of the invention is to provide a wall mounted clothing display which is moveably positionable with respect to the wall on which it is mounted.

Another object of the invention is to provide a display apparatus having a moveable bar which is suspended at either end in a manner which permits orientation and translational movement with respect to the mounting plane.

A further object of the invention is to provide a versatile joint which will permit both angular and translational displacement of a suspension bar with respect to two parallel cantilevered supports.

Other objects and advantages of the invention will be obvious from the detailed description of a preferred embodiment given hereinbelow.

SUMMARY OF THE INVENTION

The aforementioned objects are realized by a preferred embodiment of the invention which comprises a pair of horizontal parallel support members, each of which is cantilevered to a wall or other vertical mounting plane. A horizontal bar is suspended between the cantilevered support members at each end by a rotatable sliding sleeve arrangement which permits both angular as well as horizontal displacement of the ends of the bar with respect to its cantilevered support members.

DETAILED DESCRIPTION OF A PREFERRED EMBODIMENT

Figure 1:
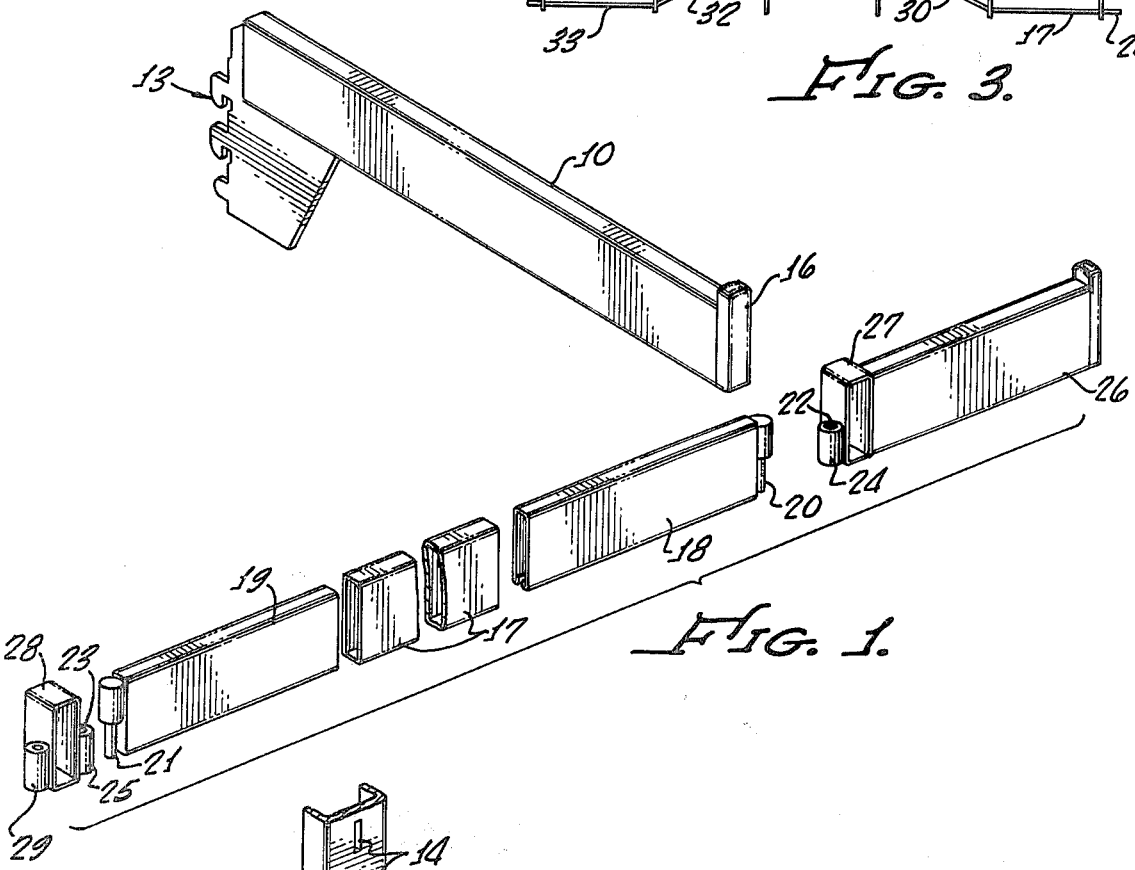
FIG. 1 shows an exploded perspective view illustrating a common section and one end section of a preferred embodiment of the device.
Figure 2:
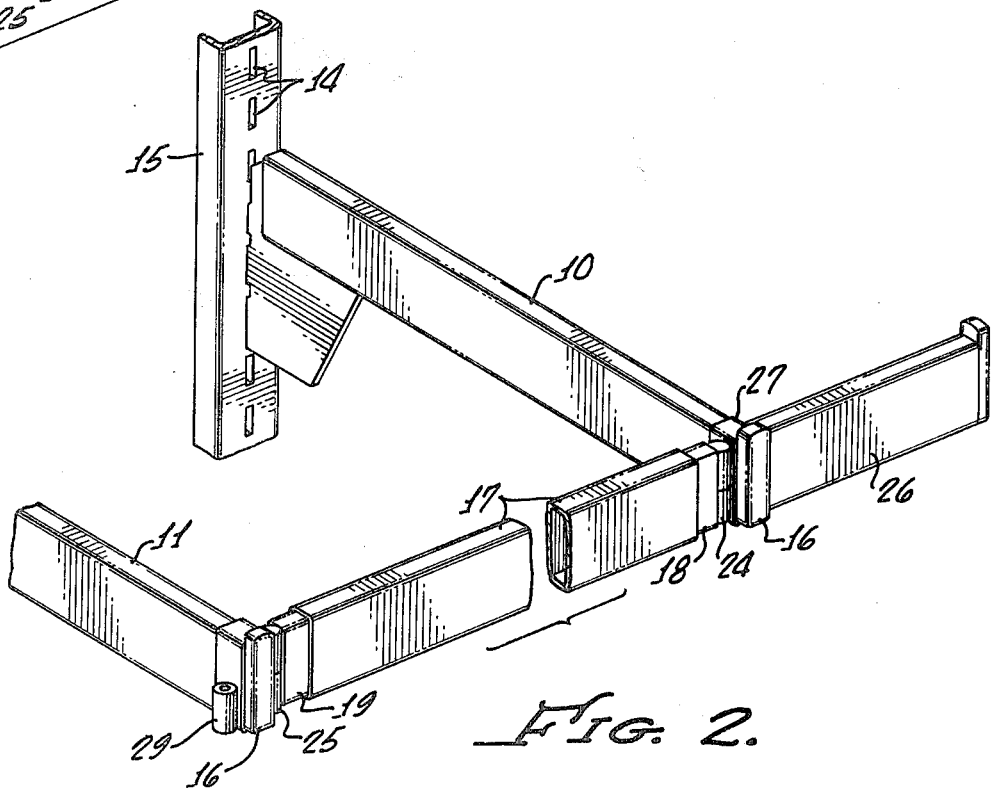
FIG. 2 shows a perspective view of the end and one common section mounted on a typical wall system.

Adverting to the drawings, and particularly FIGS. 1 and 2, a preferred embodiment of the invention comprises a pair of members 10 and 11, each having a mounting flange (shown only on member 10), which is fabricated to form a plurality of teeth 13 for engaging the accordant slots 14 of a wall system mounting post 15. The members 10 and 11 are preferrably of a round or rectangular cross section, and each includes a removable raised stop 16 at its outer extremity.

Hollow suspension bar 17 is supported between members 10 and 11 by slidable insert members 18 and 19. The internal dimensions of the suspension bar 17 are designed to form a slip fit with respect to the external dimensions of slidable insert members 18 and 19. Member 18 includes a bearing pin 20 and member 19 includes a bearing pin 21, each being adapted to fit into the accordant openings 22 and 23 of the cylinders 24 and 25 respectively. Cylinder 24 is attached to the right side end bar 26 via slidable housing 27, and cylinder 25 is attached to slidable housing 28. Slidable housing 27 is adapted to ride on the surface of, and to be freely positionable with respect to member 10; slidable housing 28 is similarly adapted to ride on and be positionable with respect to member 11. Where individual displays are contemplated, slidable housing 28 will be attached to either end to compliment the other end bar; otherwise, it will be attached to a second cylinder 29 (as shown), having an opening to receive the bearing pin of another slide member for supporting the right end of another suspension bar, and so on,—the number of consecutive sections being limited only by the length of the wall space available.

Figure 3:
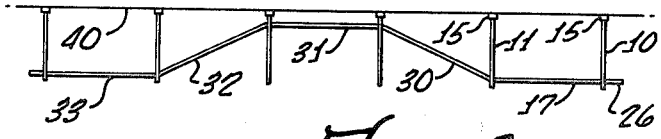
FIG. 3 shows a plan view of one possible arrangement of a five section display.

FIG. 3 indicates one of the innumerable arrangements which can be formed. In this configuration, suspension bar 17 is set fully forward at both ends (slidable housings 27 and 28 are positioned at the limit posed by the stops 16); suspension bar 33 is also positioned fully forward, and suspension bar 31 is recessed parallel to the support wall 40. Suspension bars 30 and 32 are oriented at an angle with respect to the wall 40, the necessary elongation being effected by the telescoping action between the suspension bars and their respective slidable inserts. Any and all of the above configurations can, of course, be accomplished without tools, disassembly, or without extra parts.

Although the basic concepts of the invention have been described in connection with a particular embodiment, it will be evident that the embodiment is exemplary only, and that the invention is not limited thereto, and that numerous changes, modifications, and substitutions may be made without departing from the spirit of the invention.

We claim:

1. A garment display rack comprising:

a telescoping suspension bar;

a first member adapted to support one end of said telescoping suspension bar;

a second member adapted to support the other end of said telescoping suspension bar;

means for attaching one end of said telescoping suspension bar to said first support member so as to permit said suspension bar to be translated or rotated in a horizontal plane; and means for attaching the other end of said telescoping suspension bar to said second support member so as to permit said suspension bar to be translated or rotated in a horizontal plane and, wherein said means for attaching the end of the suspension bar to said first member to permit translation and rotation, comprises:

a pivotal joint attached to one end of said telescoping suspension bar;

a slidable sleeve adapted to translate with respect to said first member;

a bearing support for engaging said pivotal joint; and means for attaching said bearing support to said slidable sleeve.

2. A positionable display comprising:

1st and 2nd elongated members adapted to form a telescoping suspension bar;

1st journal means attached to the end of said 1st elongated member;

1st bearing means adapted to engage said 1st journal means;

1st slide means for mounting said 1st bearing means so as to permit said 1st bearing means to translate in a horizontal plane;

2nd journal means attached to the end of said 2nd elongated member;

2nd bearing means adapted to engage said 2nd journal means;

2nd slide means for mounting said 2nd bearing means so as to permit said 2nd bearing means to translate in a horizontal plane.

3. The apparatus recited in claim 2 wherein said 1st slide means comprises:

an elongated bar having a uniform cross section;

means for mounting said elongated bar in a horizontal plane;

a slideable housing adapted to ride on said elongated bar.

4. The apparatus recited in claim 3 wherein said elongated bar has a rectangular cross section, and wherein said slideable housing comprises:

a rectangular opening of a size sufficient to encompass said elongated bar so as to form a slideable sleeve.

5. A positionable display comprising:

1st and 2nd elongated members adapted to form a telescoping suspension bar;

1st journal means attached to the end of said 1st elongated member;

1st bearing means adapted to engage said 1st journal means;

1st slide means for mounting said 1st bearing means so as to permit said 1st bearing means to translate in a horizontal plane;

and wherein said 1st journal means and said 1st bearing means are adapted to support said telescoping suspension bar so as to permit said telescoping suspension bar to be rotatable in a horizontal plane about a vertical axis defined by said 1st bearing means and said 1st journal means;

and wherein said 1st journal means is attached to a slideable housing so as to permit said 1st elongated telescoping member to be displaced in a horizontal plane.

* * * * *